US010147531B2

(12) United States Patent
Rai et al.

(10) Patent No.: US 10,147,531 B2
(45) Date of Patent: Dec. 4, 2018

(54) COOLING METHOD FOR PLANAR ELECTRICAL POWER TRANSFORMER

(71) Applicant: LEAR CORPORATION, Southfield, MI (US)

(72) Inventors: Rutunj Rai, Canton, MI (US); Venkat Rao Yalamanchili, Farmington Hills, MI (US); Parminder Brar, Windsor (CA); Michael Scott Duco, Fraser, MI (US)

(73) Assignee: Lear Corporation, Southfield, MI (US)

( * ) Notice: Subject to any disclaimer, the term of this patent is extended or adjusted under 35 U.S.C. 154(b) by 439 days.

(21) Appl. No.: 14/681,437

(22) Filed: Apr. 8, 2015

(65) Prior Publication Data

US 2016/0254085 A1 Sep. 1, 2016

Related U.S. Application Data

(63) Continuation-in-part of application No. 14/632,339, filed on Feb. 26, 2015, now Pat. No. 10,062,496.

(51) Int. Cl.
*H01F 27/22* (2006.01)
*H01F 27/18* (2006.01)
(Continued)

(52) U.S. Cl.
CPC ..... *H01F 27/18* (2013.01); *H01F 5/00* (2013.01); *H01F 27/22* (2013.01); *H01F 27/2876* (2013.01); *H01F 27/306* (2013.01)

(58) Field of Classification Search
CPC ..... H01F 5/00; H01F 27/00–27/36
(Continued)

(56) References Cited

U.S. PATENT DOCUMENTS 3,539,959 A * 11/1970 Wildi ..... H01F 27/2866 336/183
3,541,487 A 11/1970 Leonard
(Continued)

FOREIGN PATENT DOCUMENTS

CN 201266530 Y 7/2009
CN 103366932 A 10/2013
(Continued)

OTHER PUBLICATIONS

English language Abstract of JP2011182500A.
English language of Abstract JPH07297043A.

*Primary Examiner* — Tuyen Nguyen
(74) *Attorney, Agent, or Firm* — Fishman Stewart PLLC

(57) ABSTRACT

The present disclosure includes an electrical power transformer that may include a core and a conductor pack. A conductor pack may include a conducting layer disposed around a portion of the core, a first planar insulating layer disposed on a first side of the conducting layer, and a second planar insulating layer disposed on a second side of the conducting layer. A cooling member may be disposed adjacent to the conductor pack. A method of manufacturing an electrical power transformer may include providing a core and providing a plurality of planar conductor packs. The planar conductor packs including a plurality of planar conducting layers and a plurality of planar insulating layers. The method may include inserting a cooling member between insulating layers of adjacent ones of the plurality of planar conductor packs.

20 Claims, 9 Drawing Sheets

(51) Int. Cl.
*H01F 5/00* (2006.01)
*H01F 27/28* (2006.01)
*H01F 27/30* (2006.01)

(58) Field of Classification Search
USPC ..... 336/55–62, 200, 232
See application file for complete search history.

(56) References Cited

U.S. PATENT DOCUMENTS 4,577,175 A * 3/1986 Burgher ..... H01F 27/10 336/183
4,628,407 A 12/1986 August et al.
4,872,102 A 10/1989 Getter
4,956,626 A * 9/1990 Hoppe ..... H01F 27/085 165/179
5,010,314 A * 4/1991 Estrov ..... H01F 5/02 336/183
5,408,209 A 4/1995 Tanzer et al.
5,469,124 A 11/1995 O'Donnell et al.
5,504,655 A 4/1996 Underwood et al.
5,656,984 A 8/1997 Paradis et al.
5,949,191 A 9/1999 Cassese et al.
5,973,923 A 10/1999 Jitaru
6,087,916 A 7/2000 Kutkut et al.
6,144,276 A * 11/2000 Booth ..... H01F 27/2876 336/200
6,201,701 B1 3/2001 Linden et al.
6,222,733 B1 4/2001 Gammenthaler
6,278,353 B1 * 8/2001 Downing ..... H01F 27/2804 336/200
6,844,802 B2 1/2005 Drummond et al.
6,943,293 B1 9/2005 Jeter et al.
7,130,197 B2 10/2006 Chin
7,164,584 B2 1/2007 Walz
7,236,368 B2 6/2007 Maxwell et al.
7,289,329 B2 10/2007 Chen et al.
7,295,448 B2 11/2007 Zhu
7,375,287 B2 5/2008 Rathmann
7,375,974 B2 5/2008 Kirigaya
7,471,534 B2 12/2008 Andersson et al.
7,554,817 B2 6/2009 Nakakita et al.
7,791,887 B2 9/2010 Ganev et al.
7,907,039 B2 3/2011 Yargole et al.
7,920,039 B2 4/2011 Shabany et al.
7,952,225 B2 5/2011 Reichard et al.
8,232,855 B2 * 7/2012 El-Barbari ..... H01F 27/16 336/232
8,284,004 B2 10/2012 Tegart
8,665,596 B2 3/2014 Brereton
8,742,876 B2 6/2014 Chartouni et al.
8,848,375 B2 9/2014 Rai et al.
2010/0254093 A1 10/2010 Oota et al.
2012/0092108 A1 4/2012 Prabhakaran et al.
2013/0134925 A1 5/2013 Sharaf et al.
2013/0312930 A1 11/2013 Yalamanchili et al.
2013/0312931 A1 11/2013 Sharaf et al.

FOREIGN PATENT DOCUMENTS

CN 203850116 U 9/2014
JP H07297043 A 11/1995
JP 2011182500 A 9/2011
JP 2015133440 * 7/2015
TW 328135 B 3/1998

* cited by examiner

COOLING METHOD FOR PLANAR ELECTRICAL POWER TRANSFORMER

REFERENCE TO RELATED APPLICATIONS

This application is a continuation-in-part of U.S. patent application Ser. No. 14/632,339 filed on Feb. 26, 2015, which is hereby incorporated by reference in its entirety as though fully set forth herein.

TECHNICAL FIELD

The present disclosure relates to electrical components, electrical power transformers, and methods for cooling electrical power transformers.

BACKGROUND

Electrical power transformers may generate heat during use. Conventional power transformers may not be able to effectively dissipate heat generated and/or may use cooling means that are inefficient or expensive. Conventional power transformers may include coil-shaped conductors, and reducing heat associated with such conductors may present different challenges than those associated with planar electrical power transformers.

SUMMARY

The present disclosure includes an electrical power transformer that, in embodiments, may comprise a core and a conductor pack. In embodiments, the conductor pack may include a conducting layer disposed around a portion of the core, a first planar insulating layer disposed on a first side of the conducting layer, and a second planar insulating layer disposed on a second side of the conducting layer. In embodiments, the electrical power transformer may include a cooling member that is disposed adjacent the conductor pack. In embodiments, a plurality of conductor packs may be provided, and the cooling member may be provided between a first conductor pack and a second conductor pack.

In embodiments, a method of manufacturing an electrical power transformer may comprise providing a core and providing a plurality of planar conductor packs. In embodiments, a conductor pack may include a plurality of planar conducting layers and a plurality of planar insulating layers. In embodiments, manufacturing may include inserting at least a portion of a cooling member between insulating layers of adjacent conductor packs.

DETAILED DESCRIPTION

Reference will now be made in detail to embodiments of the present disclosure, examples of which are described herein and illustrated in the accompanying drawings. While the disclosure will be described in conjunction with embodiments and/or examples, it will be understood that they are not intended to limit the present disclosure to these embodiments and/or examples. On the contrary, the present disclosure is intended to cover alternatives, modifications and equivalents, which may be included within the spirit and scope of the present disclosure.

Figure 1:
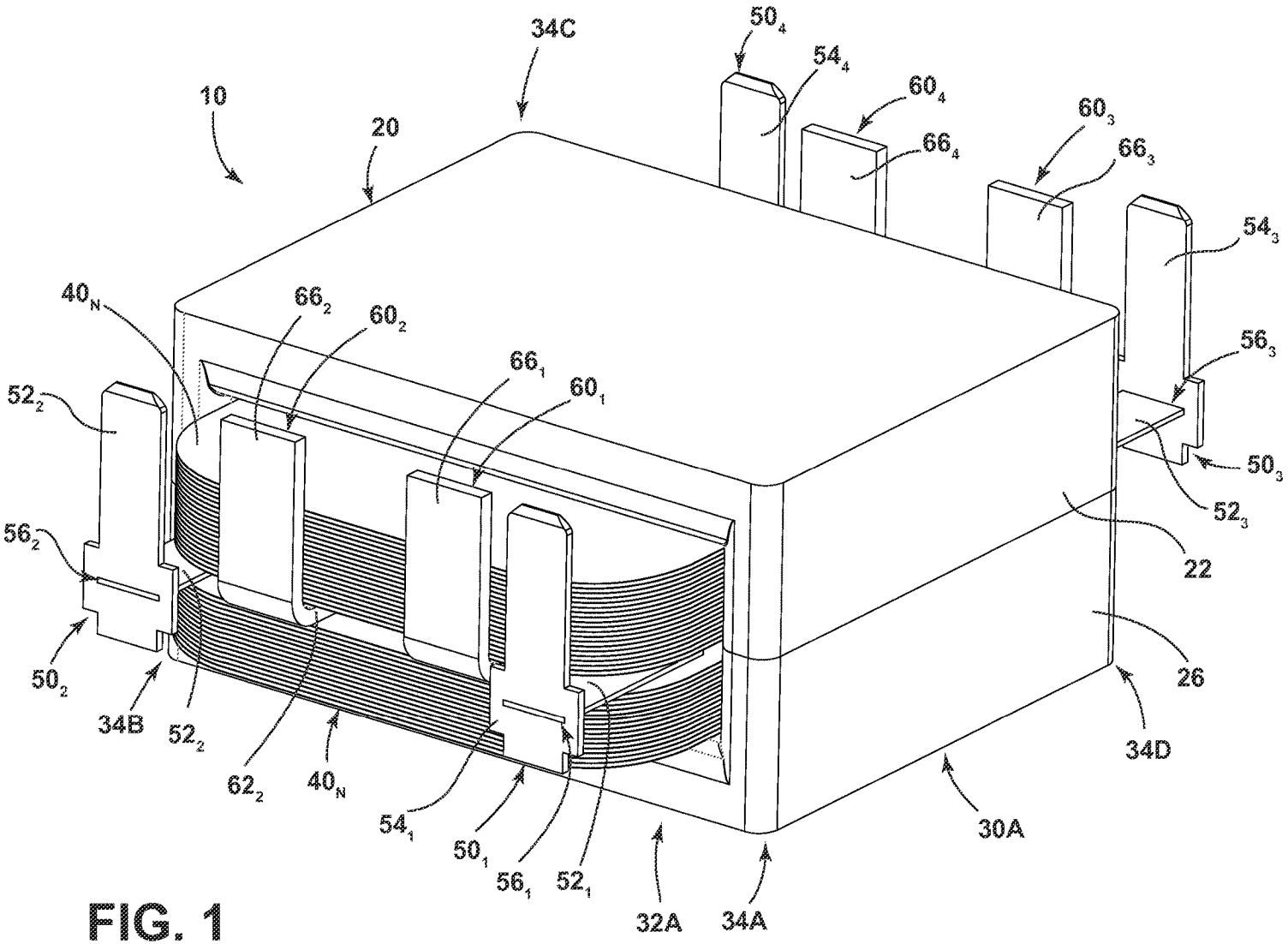
FIG. 1 is an isometric view of portions of an embodiment of a planar electrical power transformer in accordance with teachings of the present disclosure.
Figure 2:
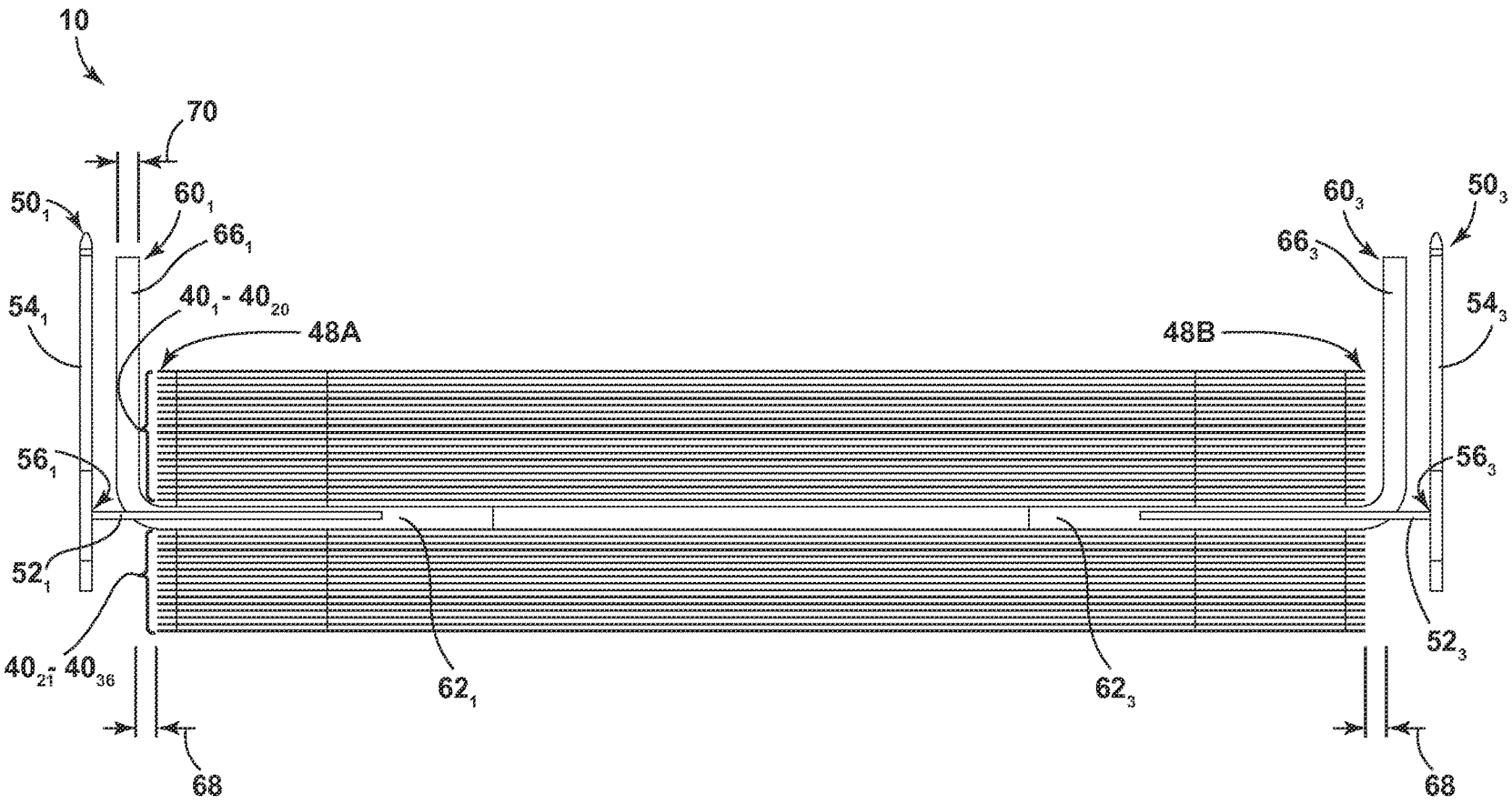
FIG. 2 is an isometric view of portions of an embodiment of a planar electrical power transformer in accordance with teachings of the present disclosure.

In embodiments, such as generally illustrated in FIGS. 1 and 2, a planar electrical power transformer 10 may include a core 20, a conductor pack $\mathbf{40}_N$, a terminal $\mathbf{50}_N$ (e.g., terminals $\mathbf{50}_1$, $\mathbf{50}_2$, $\mathbf{50}_3$, and $\mathbf{50}_4$), and/or a cooling member. The cooling member may comprise, for example, one or more of cooling members $\mathbf{60}_N$ (e.g., cooling members $\mathbf{60}_1$, $\mathbf{60}_2$, $\mathbf{60}_3$, and $\mathbf{60}_4$), 80, or 110. Planar electrical power transformer 10 may also be referred to herein as transformer 10.

Figure 3A:
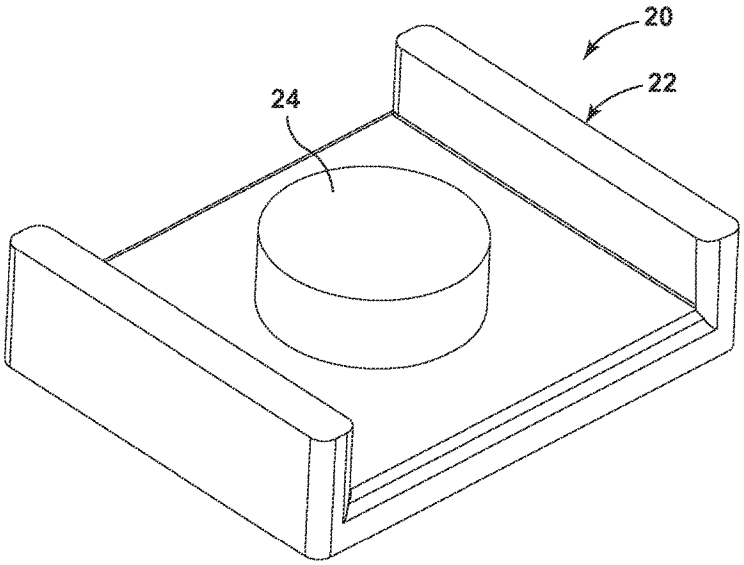
FIGS. 3A and 3B are isometric views of portions of an embodiment of cores of a planar electrical power transformer in accordance with teachings of the present disclosure.
Figure 3B:
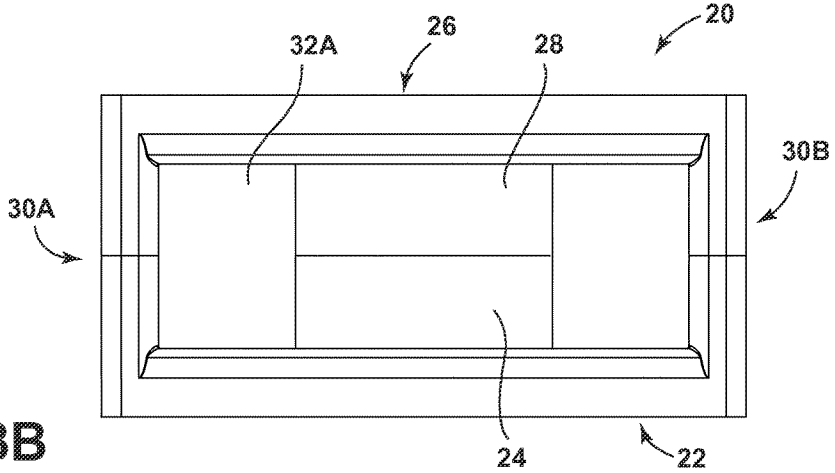

In embodiments, such as generally illustrated in FIGS. 3A and 3B, core 20 may be magnetic and may include a first portion 22 and a second portion 26, which may or may not be identical or mirror images. First portion 22 and second portion 26 may each include a respective projection (e.g., illustrated projections 24, 28) that may be configured to at least partially house, hold and/or restrain one or more conductor packs $\mathbf{40}_N$. For example, and without limitation, a plurality of conductor packs $\mathbf{40}_N$ may include respective apertures $\mathbf{46}_N$ (see, e.g., FIGS. 4A and 4B) and projections 24, 28 may be configured to be collectively or independently (e.g., relative to each other) inserted into apertures $\mathbf{46}_N$ and/or to extend through apertures $\mathbf{46}_N$. Core 20 may include one or more side walls (e.g., illustrated side walls 30A, 30B) and/or one or more open sides (e.g., illustrated open sides 32A, 32B). In embodiments, conductor packs $\mathbf{40}_N$ may extend between side walls 30A, 30B and out from open sides 32A, 32B.

Figure 4A:
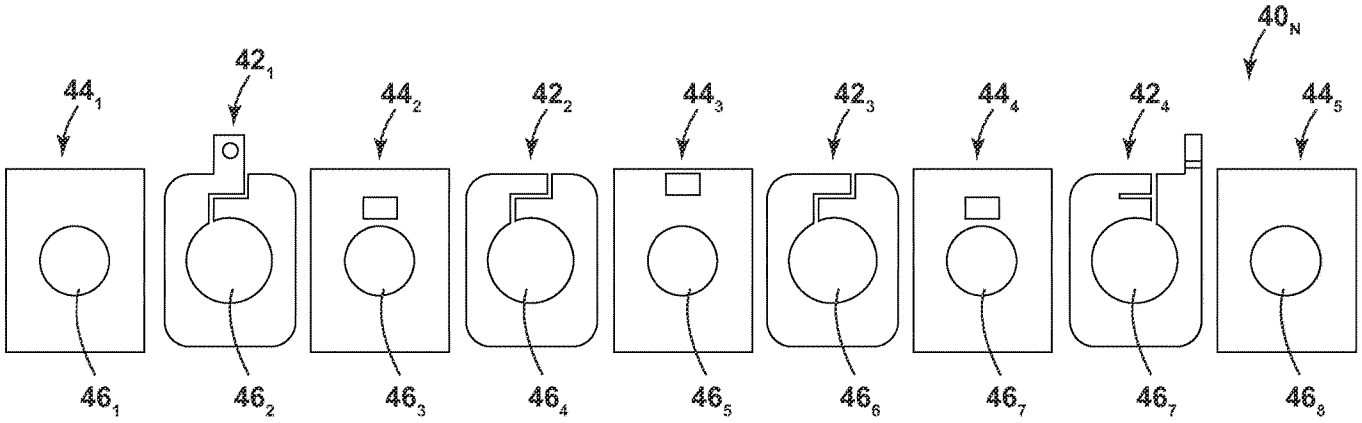
FIG. 4A is a exploded view of an embodiment of a conductor pack of a planar electrical power transformer in accordance with teachings of the present disclosure.
Figure 5:
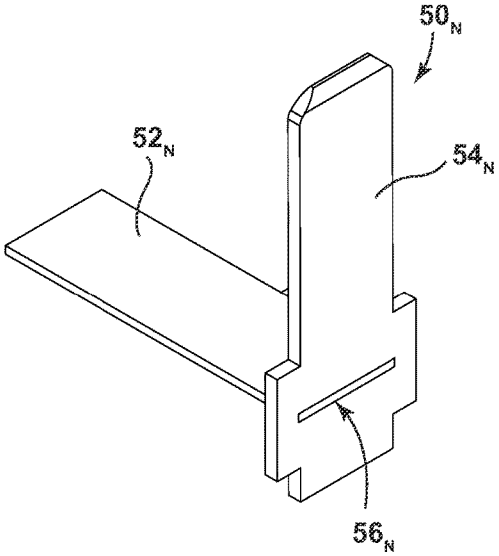
FIG. 5 is an isometric view of an embodiment of an electrical terminal of a planar electrical power transformer in accordance with teachings of the present disclosure.
Figure 4B:
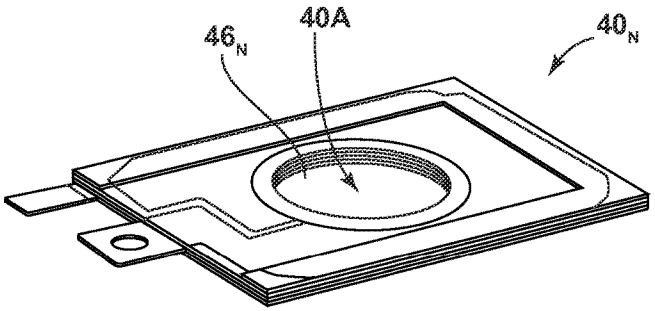
FIG. 4B is an isometric view of an embodiment of a conductor pack of a planar electrical power transformer in accordance with teachings of the present disclosure.

In embodiments, such as generally illustrated in FIGS. 2, 4A and 4B, a conductor pack $\mathbf{40}_N$ (e.g., conductor packs $\mathbf{40}_1$-$\mathbf{40}_{36}$) may be planar and may include one or more conducting layers $\mathbf{42}_N$ that may be planar and/or one or more insulating layers $\mathbf{44}_N$ that may be planar. In embodiments, a conductor pack $\mathbf{40}_N$ may include an alternating layer configuration in which an insulating layer $\mathbf{44}_N$ is disposed on each side (e.g., top and bottom) of each conducting layer $\mathbf{42}_N$. For example, conducting layer $\mathbf{42}_1$ may be disposed between insulating layers $\mathbf{44}_1$ and $\mathbf{44}_2$; conducting layer $\mathbf{42}_2$ may be disposed between insulating layers $\mathbf{44}_2$ and $\mathbf{44}_3$; conducting layer $\mathbf{42}_3$ may be disposed between insulating layers $\mathbf{44}_3$ and $\mathbf{44}_4$; and/or conducting layer $\mathbf{42}_4$ may be disposed between insulating layers $\mathbf{44}_4$ and $\mathbf{44}_5$. In embodiments, one or more of the plurality of conducting layers $\mathbf{42}_N$, the plurality of insulating layers $\mathbf{44}_N$, and/or a cooling member $\mathbf{60}_N$, 80, 110 may be disposed at least partially around core 20. The conducting layers $\mathbf{42}_N$ may effectively function as coils of a similar nature to those of a conventional transformer and, in conjunction with the core 20, which may be magnetic, may allow for electrical energy received at one or more of terminals $\mathbf{50}_N$ to be transformed from an original voltage to a different voltage, which may be available at one or more other terminals $\mathbf{50}_N$.

In embodiments, such as generally illustrated in FIGS. 1, 2, 5, and 7 an electrical terminal $\mathbf{50}_N$ may be disposed at least partially between adjacent conductor packs $\mathbf{40}_N$ and/or may extend laterally outward (e.g., from open sides 32A, 32B) beyond conductor packs $\mathbf{40}_N$. For example, and without limitation, an electrical terminal $\mathbf{50}_N$ may include a first portion $\mathbf{52}_N$ that may be planar and/or may be disposed at least partially between adjacent conductor packs $\mathbf{40}_N$ (e.g., may be generally horizontal). An electrical terminal $\mathbf{50}_N$ may include a second portion $\mathbf{54}_N$ that may not be disposed between adjacent conductor packs $\mathbf{40}_N$. First portions $\mathbf{52}_N$ may or may not be disposed at least partially between core first portion 22 and core second portion 26. A terminal second portion $\mathbf{54}_N$ may be disposed at or near an outer end $\mathbf{56}_N$ (e.g., outer ends $\mathbf{56}_1$, $\mathbf{56}_2$, $\mathbf{56}_3$, $\mathbf{56}_4$) of a first portion $\mathbf{52}_N$, may be disposed generally vertically, may be generally planar, and/or may be disposed generally perpendicularly to a first portion $\mathbf{52}_N$. Electrical terminals $\mathbf{50}_N$ may be configured as blade terminals. In embodiments, for example and without limitation, transformer 10 may include four terminals $\mathbf{50}_1$, $\mathbf{50}_2$, $\mathbf{50}_3$, $\mathbf{50}_4$ that may each be disposed at or near respective corners 34A, 34B, 34C, 34D of conductor packs $\mathbf{40}_N$.

In embodiments, such as generally illustrated in FIGS. 1, 2, and 6A-10, transformer 10 may include one or more cooling members $\mathbf{60}_N$, 80, 110. In embodiments, such as generally illustrated in FIGS. 1, 2, 6A, 6B, and 7, a cooling member $\mathbf{60}_N$ may include a first portion $\mathbf{62}_N$ and/or a second portion $\mathbf{66}_N$. First portion $\mathbf{62}_N$ may be connected to second portion $\mathbf{66}_N$ and/or may be in fluid communication with second portion $\mathbf{66}_N$ (including as disclosed further herein). In embodiments, first portion $\mathbf{62}_N$ and second portion $\mathbf{66}_N$ may form a unitary body that may, for example, be generally L-shaped. First portion $\mathbf{62}_N$ may be generally horizontal and/or may be disposed at least partially between adjacent conductor packs $\mathbf{40}_N$. First portion 62 may be disposed adjacent to one or more conductor packs $\mathbf{40}_N$. Second portion $\mathbf{66}_N$ may be generally vertical and/or may be disposed at or about an outer end $\mathbf{64}_N$ of first portion $\mathbf{62}_N$ (e.g., relative to a center 40A of conductor packs $\mathbf{40}_N$). First portion $\mathbf{62}_N$ and second portion $\mathbf{66}_N$ may be connected together in one or more of a variety of ways, such as, for example, at a right angle or in a curved configuration.

Figure 6A:
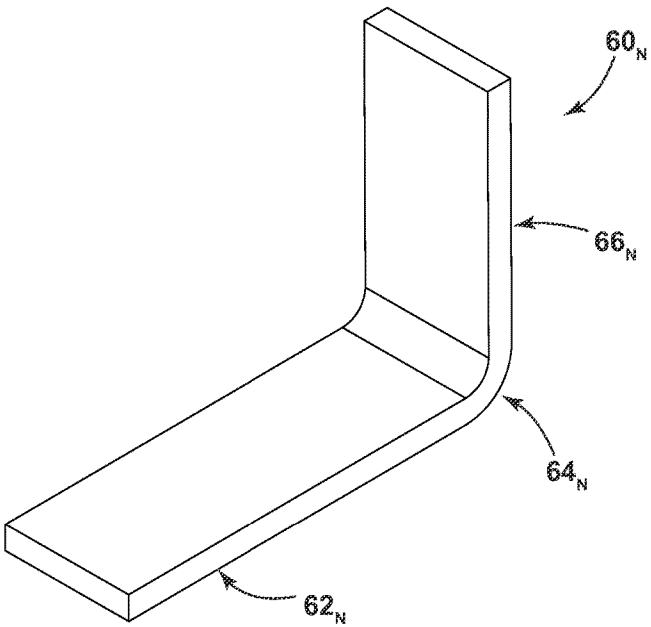
FIG. 6A is an isometric view of an embodiment of a cooling member of a planar electrical power transformer in accordance with teachings of the present disclosure.
Figure 6B:
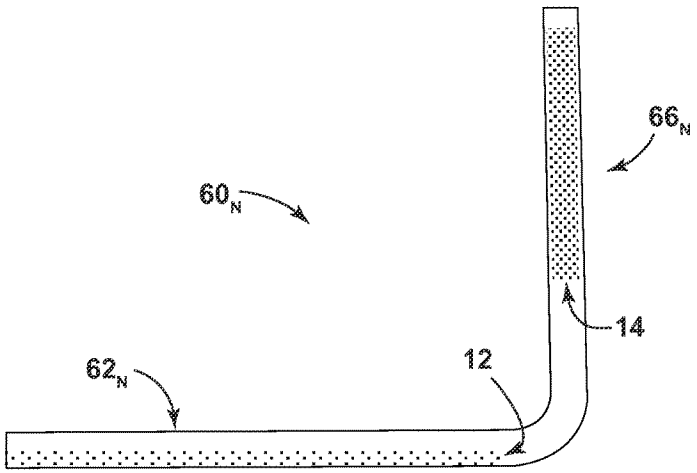
FIG. 6B is a side view of an embodiment of a cooling member of a planar electrical power transformer in accordance with teachings of the present disclosure.
Figure 7:
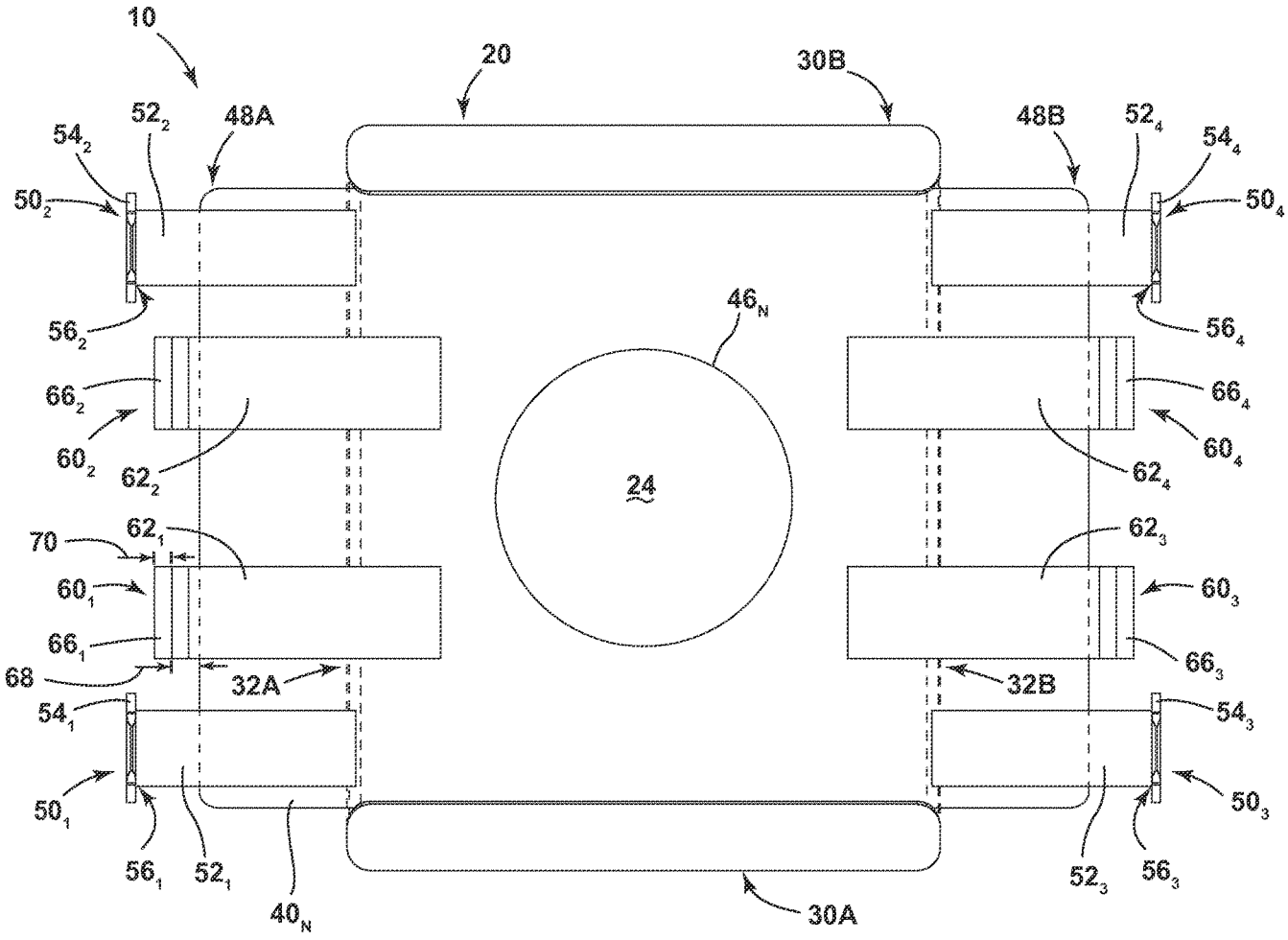
FIG. 7 is an isometric view of portions of an embodiment of a planar electrical power transformer in accordance with teachings of the present disclosure.

In embodiments, such as generally illustrated in FIGS. 6A, 6B, and 7, a cooling member $\mathbf{60}_N$ may be configured as a heat pipe and/or a heat shunt. For example, and without limitation, first portion $\mathbf{62}_N$ and second portion $\mathbf{66}_N$ may be generally hollow and/or may include a hollow segment. Further, first portion $\mathbf{62}_N$ and second portion $\mathbf{66}_N$ may contain a fluid 12. Fluid 12 may include one or more of a variety of compositions as may be operatively suitable for an intended environment or application. In embodiments, fluid 12 may comprise a liquid and/or may be referred to herein as liquid 12, but is not so limited. Liquid 12 may comprise one or more of variety of compositions. For example, and without limitation, liquid may include glycol. In embodiments, if heat is generated by transformer 10, cooling member $\mathbf{60}_N$ may help dissipate the heat, such as via convection. For instance, if heat is generated by transformer 10, the heat may increase the temperature of liquid 12 in first portion $\mathbf{62}_N$ such that the liquid 12 may turn into vapor 14 and move into second portion $\mathbf{66}_N$. Second portion $\mathbf{66}_N$ may be disposed at a distance 68 from (e.g., so as to avoid contact with) conductor packs $\mathbf{40}_N$ and/or core 20. A spaced distance 68 may allow second portion $\mathbf{66}_N$ to be exposed to a greater amount of ambient air (which may be relatively cooler) than air associated with first portion $\mathbf{62}_N$ and/or may allow second portion $\mathbf{66}_N$ to be or become cooler than first portion $\mathbf{62}_N$. Distance 68 may, for example and without limitation, be about the same as the thickness 70 of second portion $\mathbf{66}_N$, but may be larger or smaller in certain embodiments.

In embodiments, if vapor 14 reaches second portion $\mathbf{66}_N$, vapor 14 may begin cooling and/or dissipating heat generated by transformer 10. Vapor 14 in second portion $\mathbf{66}_N$ may cool sufficiently to condense back into a liquid 12. If vapor 14 condenses back into a liquid 12 in second portion $\mathbf{66}_N$, the liquid 12 may return to first portion $\mathbf{62}_N$. This process of heating liquid 12 until it becomes vapor 14 and then cooling the vapor 14 until it condenses back into a liquid 12 may repeat and continue dissipating heat if transformer 10 continues to generate heat. Cooling member $\mathbf{60}_N$ may be a closed system, which may include being configured such that the amount of fluid (e.g., a combined amount of liquid and vapor) within cooling member $\mathbf{60}_N$ remains constant or substantially constant (e.g., liquid 12 or vapor 14 may not be added to or removed from cooling member $\mathbf{60}_N$). Cooling member $\mathbf{60}_N$ may be configured to cool transformer 10 independently of pumps or other devices that may cause fluid flow.

In embodiments, transformer 10 may include a plurality of cooling members $\mathbf{60}_N$, such as, for example, a first cooling member $\mathbf{60}_1$, a second cooling member $\mathbf{60}_2$, a third cooling member $\mathbf{60}_3$, and/or a fourth cooling member $\mathbf{60}_4$. In embodiments, each cooling member $\mathbf{60}_N$ may or may not be identical to each other cooling member $\mathbf{60}_N$. In an embodiment, first cooling member $\mathbf{60}_1$ and second cooling member $\mathbf{60}_2$ may be disposed at or near a first end 48A of conductor packs $\mathbf{40}_N$ and/or may be disposed between terminals $\mathbf{50}_1$, $\mathbf{50}_2$. First cooling member $\mathbf{60}_1$ and second cooling member $\mathbf{60}_2$ may be aligned with each other such that first portions $\mathbf{62}_1$, $\mathbf{62}_2$ both extend the same distance between adjacent conductor packs $\mathbf{40}_N$. Third cooling member $\mathbf{60}_3$ and fourth cooling member $\mathbf{60}_4$ may be disposed at or near a second end 48B of conductor packs $\mathbf{40}_N$ and/or may be disposed between terminals $\mathbf{50}_3$, $\mathbf{50}_4$. Third cooling member $\mathbf{60}_3$ and fourth cooling member $\mathbf{60}_4$ may be aligned with each other such that first portions $\mathbf{62}_3$, $\mathbf{62}_4$ both extend the same distance between adjacent conductor packs. In embodiments, terminals $\mathbf{50}_N$ and cooling members $\mathbf{60}_N$ may all be disposed between the same pair of adjacent conductor packs $40_N$. In embodiments, at least one cooling member $60_N$ may be disposed between a pair of adjacent conductor packs $40_N$ and at least one other cooling member $60_N$ may be disposed between a different pair of adjacent conductor packs $40_N$.

Figure 8B:
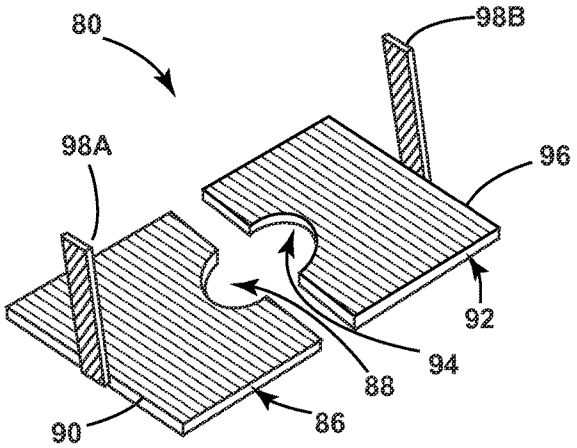
FIGS. 8A-8B are isometric views of embodiments of cooling members of planar electrical power transformers in accordance with teachings of the present disclosure.
Figure 8A:
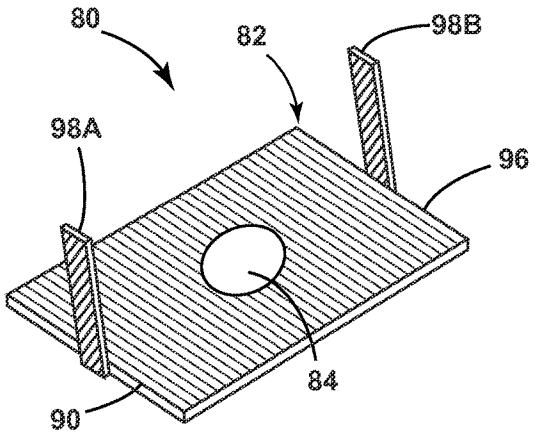
Figure 8C:
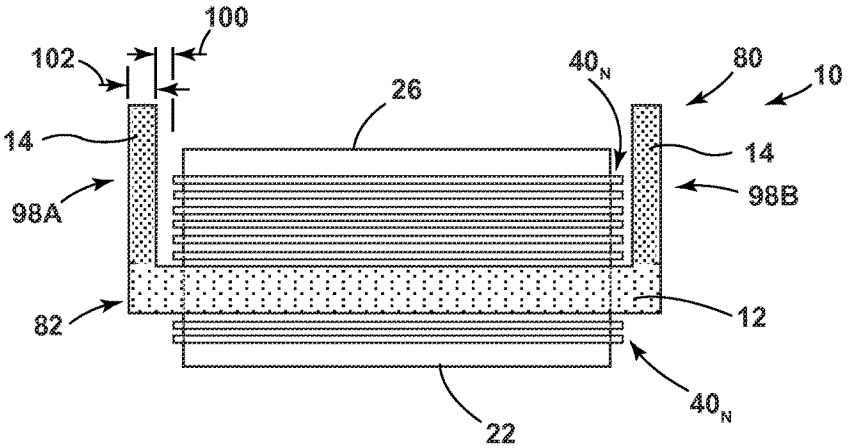
FIG. 8C is a side view of an embodiment of a cooling member of a planar electrical power transformer in accordance with teachings of the present disclosure.

In embodiments, such as generally illustrated in FIGS. 8A, 8B, and 8C, a cooling member 80 may include a cooling layer and/or may be referred to herein as cooling layer 80. Cooling layer 80 may function in the same or a similar manner as a heat pipe. Cooling layer 80 may include a unitary body that may comprise a horizontal portion 82 and one or more vertical portions (e.g., illustrated vertical portions 98A and 98B). A horizontal portion 82 may be disposed at least partially between adjacent conductor packs $40_N$ and may include a shape that is the same as or similar to the shape of the conductor packs $40_N$. For example, and without limitation, horizontal portion 82 may be configured as and/or resemble a rectangular prism and may include an aperture 84 configured for receiving a projection (e.g., projection 24 and/or projection 28). In embodiments, such as generally illustrated in FIG. 8B, a horizontal portion 82 may include a first section 86 and a second section 92 that may be separate and distinct from each other. In embodiments, first section 86 and second section 92 may be identical and/or may each be generally rectangular with a semi-circular recess 88, 94 configured to receive at least a portion of one or more of projections 24, 28. First section 86 and second section 92 may be disposed on opposite sides of projections 24, 28, which may include being disposed such that semi-circular recesses 88, 94 effectively act as an aperture similar to aperture 84 (e.g., first section 86 and second section 92 may be complementary).

In embodiments, vertical portions 98A, 98B may be disposed at an outer edge 90, 96 of horizontal portion 82. In embodiments, cooling layer 80 may include a plurality of vertical portions (e.g., vertical portions 98A, 98B). For example and without limitation, a first vertical portion 98A may be disposed at outer edge 90 of horizontal portion 82 and a second vertical portion 98B may be disposed at an opposite outer edge 96 of horizontal portion 82. In embodiments, each of first section 86 and second section 92 may include one or more vertical portions (e.g., first section 86 may include vertical portion 98A and second section 92 may include vertical portion 98B). A vertical portion 98A, 98B may be configured as or generally resemble a rectangular prism.

In embodiments, such as generally illustrated in FIG. 8C, a horizontal portion 82 and/or vertical portions 98A, 98B may be hollow. In embodiments, a horizontal portion 82 may be in fluid communication with one or more vertical portions 98A, 98B. For example, and without limitation, vertical portions 98A, 98B may be disposed at opposite sides of horizontal portion 82 (e.g., on opposite sides of core 20), and vertical portions 98A, 98B and horizontal portion 82 may all be in fluid communication with each other. A liquid 12 may be disposed in horizontal portion 82. As generally described previously in connection with cooling members $60_N$, if transformer 10 generates heat (or if horizontal portion 82 is otherwise heated), liquid 12 may be heated such that it turns into vapor 14 and flows into vertical portions 98A, 98B. Vertical portions 98A, 98B may be disposed at a distance 100 from (e.g., so as not to be in contact with) conductor packs $40_N$ and/or core 20, which may expose a greater amount of vertical portions 98A, 98B to ambient air, permit vertical portions 98A, 98B to be cooler than horizontal portion 82, and/or may permit vertical portions 98A, 98B to efficiently dissipate heat. Distance 100 may, for example only, be about the same as the thickness 102 of vertical portions 98A, 98B, but may be smaller or larger in certain embodiments.

Figure 9B:
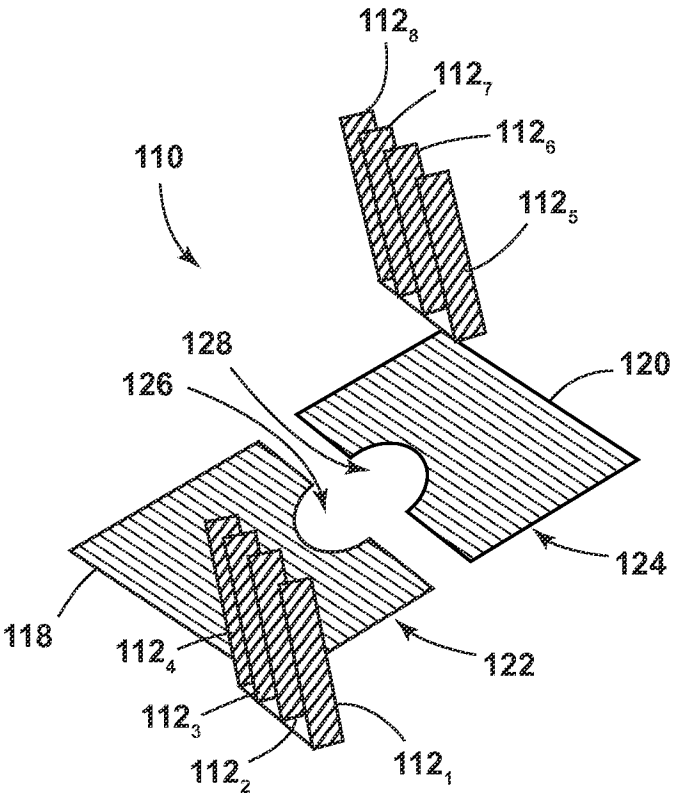
FIGS. 9A-9B are isometric views of embodiments of cooling members of planar electrical power transformers in accordance with teachings of the present disclosure.
Figure 9A:
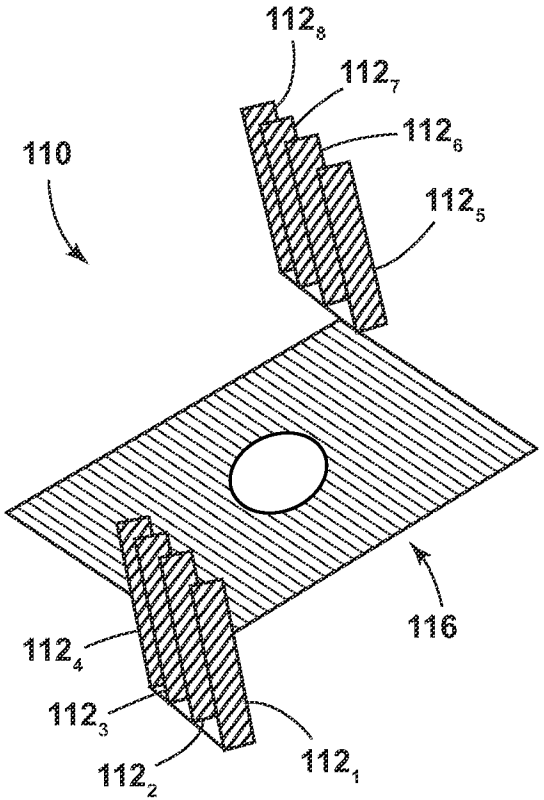
Figure 10:
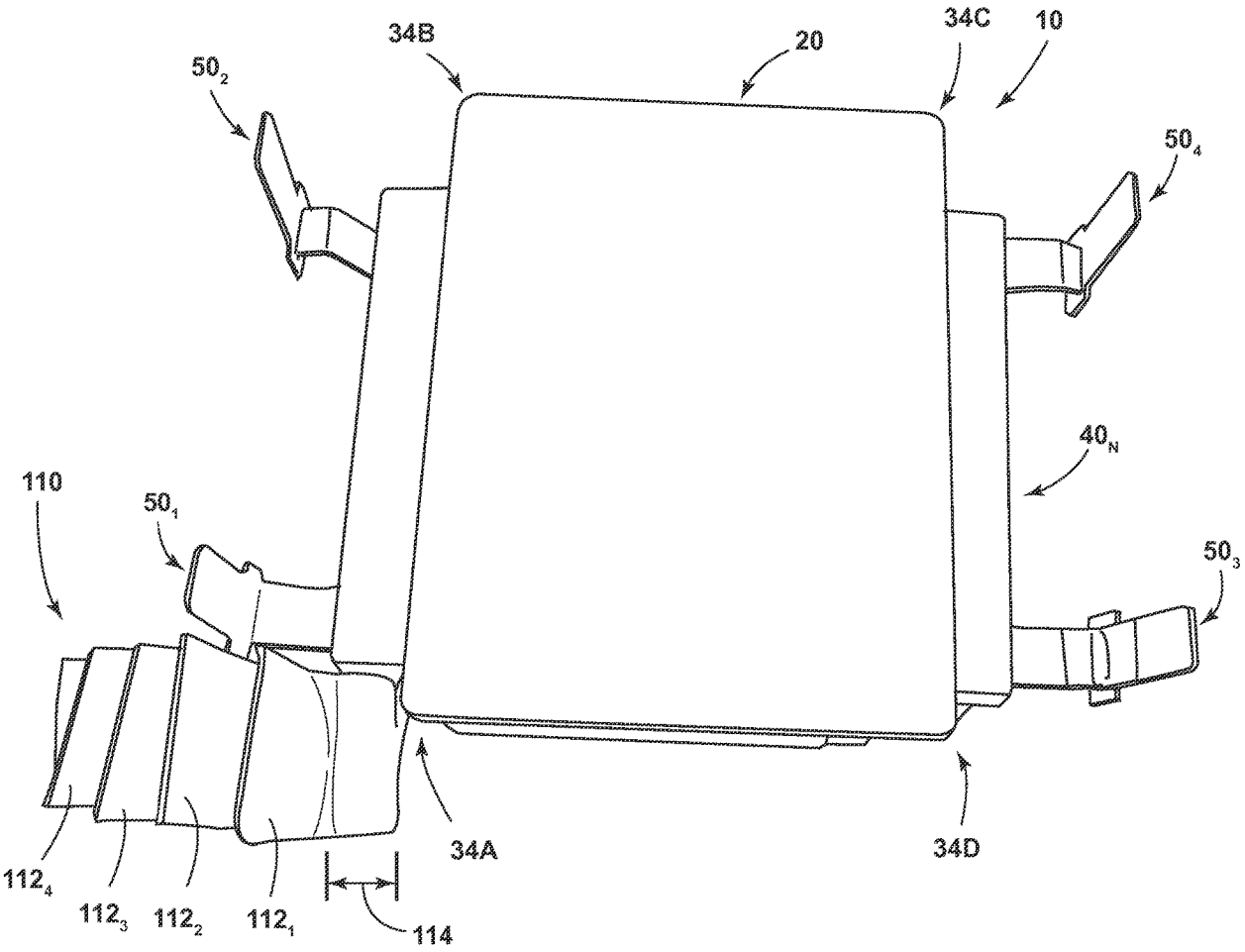
FIG. 10 is an isometric view of an embodiment of a cooling member of a planar electrical power transformer in accordance with teachings of the present disclosure.

In embodiments, such as generally illustrated in FIGS. 9A, 9B, and 10, a cooling member 110 may include one or more cooling fins $112_N$ that may be disposed at a distance 114 from (e.g., so not to be in contact with) core 20 and/or conductor packs $40_N$. Cooling fins $112_N$ may help dissipate heat generated by transformer 10, such as via thermal conduction. For example, and without limitation, cooling fins $112_N$ may be connected to a cooling layer 116 of cooling member 110 that may be planar and/or disposed between adjacent conductor packs $40_N$. Cooling layer 116 may absorb heat generated by transformer 10 and cooling fins $112_N$ may effectively draw out the heat from the cooling layer 116. Cooling fins $112_N$ may then permit the absorbed heat to dissipate into ambient air, which may help cool transformer 10.

In embodiments, cooling layer 116 may include a single, unitary body that may be generally rectangular in shape, may be generally planar, and may include fins $112_N$ disposed at a first end 118 and/or at a second end 120. In other embodiments, cooling layer 116 may include a first section 122 and a second section 124 that may be configured in the same or a similar manner as first section 86 and second section 92, respectively, of horizontal portion of cooling member 80. For example, and without limitation, first section 122 and second section 124 of cooling layer 116 may be generally planar, include generally rectangular shapes, and/or may include semicircular recesses 126, 128 configured to accommodate one or more of projections 24, 28. In embodiments, first section 122 may include first end 118 and a first plurality of fins $112_N$ may be disposed at first end 118 of first section 122. Second section 124 may include second end 120 and a second plurality of fins $112_N$ may be disposed at second end 120 of second section 124. In embodiments, cooling layer 116 and fins $112_N$ may be solid, hollow, or a combination of solid and hollow. Cooling layer 116 may comprise one or more of a variety of materials, such as, for example, materials with high thermal conductivity (e.g., aluminum, copper, a graphite pad, etc.).

In embodiments, cooling fins $112_N$ may be disposed generally vertically. One or more of cooling fins $112_N$ may be generally planar and/or may include a generally rectangular shape. Cooling fin $112_N$ may be the same or similar to each other or at least one cooling fin $112_N$ may be different from at least one other cooling fin $112_N$. In embodiments, cooling fins may be connected to cooling layer 116 at or near a corner of conductor packs and/or core (e.g., one or more of corners 34A, 34B, 34C, 34D). Cooling fins $112_N$ may be disposed laterally outside of terminals $50_N$ (e.g., as generally shown in FIG. 10) and/or may be disposed between terminals $50_N$. Cooling fins $112_N$ may be solid, hollow, and/or a combination of solid and hollow. In embodiments, cooling member 110 may be configured as a heat pipe (e.g., similar to cooling members $60_N$, 80). For example, and without limitation, fins $112_N$ and cooling layer 116 may be hollow and may contain a liquid. In other embodiments, fins $112_N$ and cooling layer 116 may be solid.

In embodiments, a method of manufacturing a transformer 10 may include providing a core 20, a plurality of conductor packs $40_N$, a plurality of terminals $50_N$, and/or one or more cooling members $60_N$, 80, 110. One or more of the conductor packs $40_N$ may be disposed around first portion 22 of core 20 (e.g., such that projection 24 extends through apertures $46_N$). Then, terminals $50_N$ and/or cooling members $60_N$, 80, 110 may be disposed on top of the conductor packs $40_N$. Next, one or more additional conductor packs $40_N$ may be disposed on top of terminals $50_N$ and/or cooling members $60_N$, 80, 110. Next, a second portion 26 of core 20 may be disposed such that projection 28 extends into through apertures $46_N$ of the additional conductor packs $40_N$ and such that second portion 26 is aligned with first portion 22. Although an example of a method of manufacturing an embodiment of a transformer 10 according to the present disclosure is provided, the present disclosure is not limited to the particular order or steps described above and various steps may be conducted in other orders.

Various embodiments are described herein to various apparatuses, systems, and/or methods. Numerous specific details are set forth to provide a thorough understanding of the overall structure, function, manufacture, and use of the embodiments as described in the specification and illustrated in the accompanying drawings. It will be understood by those skilled in the art, however, that the embodiments may be practiced without such specific details. In other instances, well-known operations, components, and elements have not been described in detail so as not to obscure the embodiments described in the specification. Those of ordinary skill in the art will understand that the embodiments described and illustrated herein are non-limiting examples, and thus it can be appreciated that the specific structural and functional details disclosed herein may be representative and do not necessarily limit the scope of the embodiments.

Reference throughout the specification to "various embodiments," "some embodiments," "one embodiment," or "an embodiment," or the like, means that a particular feature, structure, or characteristic described in connection with the embodiment is included in at least one embodiment. Thus, appearances of the phrases "in various embodiments," "in some embodiments," "in one embodiment," or "in an embodiment," or the like, in places throughout the specification are not necessarily all referring to the same embodiment. Furthermore, the particular features, structures, or characteristics may be combined in any suitable manner in one or more embodiments. Thus, the particular features, structures, or characteristics illustrated or described in connection with one embodiment may be combined, in whole or in part, with the features, structures, or characteristics of one or more other embodiments without limitation given that such combination is not illogical or non-functional.

Although only certain embodiments have been described above with a certain degree of particularity, those skilled in the art could make numerous alterations to the disclosed embodiments without departing from the scope of this disclosure. Joinder references (e.g., attached, coupled, connected, and the like) are to be construed broadly and may include intermediate members between a connection of elements and relative movement between elements. As such, joinder references do not necessarily imply that two elements are directly connected/coupled and in fixed relation to each other. The use of "e.g." throughout the specification is to be construed broadly and is used to provide non-limiting examples of embodiments of the disclosure, and the disclosure is not limited to such examples. It is intended that all matter contained in the above description or shown in the accompanying drawings shall be interpreted as illustrative only and not limiting. Changes in detail or structure may be made without departing from the present disclosure as defined in the appended claims.

What is claimed is:

1. An electrical power transformer comprising:

a core;

a conductor pack, the conductor pack including:

a conducting layer disposed around a portion of the core;

a first planar insulating layer disposed on a first side of the conducting layer; and a second planar insulating layer disposed on a second side of the conducting layer; and a cooling member disposed adjacent to the conductor pack, the cooling member including a first portion and a second portion;

wherein a plane of the second portion is substantially perpendicular to a plane of the first portion.

2. The electrical power transformer of claim 1, wherein the conductor pack is a first conductor pack; the electrical power transformer further comprises a second conductor pack; and, the cooling member is disposed partially between the first conductor pack and the second conductor pack.

3. The electrical power transformer of claim 1, wherein the cooling member comprises a plurality of separate sections disposed at least partially around the portion of the core.

4. The electrical power transformer of claim 1, wherein the cooling member includes a hollow body at least partially filled with a liquid.

5. The electrical power transformer of claim 4, wherein the hollow body includes the first portion, the first portion is substantially planar, and the first portion extends out from the conductor pack.

6. The electrical power transformer of claim 1, wherein the cooling member includes a first section and a second section; the first section and the second section are disposed in a common plane; the first section is separate from the second section; and the first section includes the first portion and the second portion.

7. The electrical power transformer of claim 2, wherein the cooling member includes a solid planar body disposed adjacent to the first conductor pack and the second conductor pack; and, the cooling member includes a plurality of fins that extend from the solid planar body outwardly beyond the first conductor pack and the second conductor pack.

8. The electrical power transformer of claim 1, wherein the conductor pack is a first conductor pack; and, the electrical power transformer further comprises a second conductor pack.

9. The electrical power transformer of claim 8, wherein the cooling member is a first cooling member; the electrical power transformer further comprises a second cooling member; and, the first cooling member and the second cooling member are both disposed partially between and in contact with the first conductor pack and the second conductor pack.

10. The electrical power transformer of claim 9, wherein the first cooling member extends from a first side of the electrical power transformer; and, the second cooling member extends from a second side of the electrical power transformer.

11. The electrical power transformer of claim 9, wherein the first cooling member and the second cooling member each comprise a hollow body containing liquid configured to (i) be heated by heat generated by operation of the electrical power transformer, and (ii) dissipate the heat generated by operation of the electrical power transformer by cooling and/or condensing.

12. The electrical power transformer of claim 5, wherein the first portion includes a first section and a second section; the first section and the second section are disposed on opposite sides of a projection of the core; and the first section is separate from the second section.

13. The electrical power transformer of claim 2, wherein the first portion is substantially horizontal and the second portion is substantially vertical, wherein at least a portion of the first portion is disposed between the first conductor pack and the second conductor pack.

14. The electrical power transformer of claim 13, wherein the second portion is disposed such that the second portion is not in contact with the first conductor pack or the second conductor pack and is not in contact with the core.

15. The electrical power transformer of claim 13, wherein the second portion is in fluid communication with the first portion and the second portion includes a plurality of cooling fins.

16. An electrical power transformer comprising:

a core;

a conductor pack, the conductor pack including:

a conducting layer disposed around a portion of the core;

a first planar insulating layer disposed on a first side of the conducting layer; and a second planar insulating layer disposed on a second side of the conducting layer; and a cooling member disposed adjacent to the conductor pack;

wherein the cooling member is a closed system configured to provide cooling independently of external devices for causing fluid flow.

17. A method of manufacturing an electrical power transformer, the method comprising:

providing a core;

providing a plurality of planar conductor packs, the planar conductor packs including a plurality of planar conducting layers and a plurality of planar insulating layers;

providing a cooling member including a substantially horizontal planar portion and a substantially vertical planar portion; and inserting the cooling member between insulating layers of adjacent ones of the plurality of planar conductor packs.

18. The method of claim 17, further comprising inserting at least a portion of the core into the plurality of planar conductor packs.

19. The method of claim 18, wherein the core includes a top portion and a bottom portion that are configured for independent insertion into apertures of the plurality of planar conductor packs.

20. The method of claim 17, wherein at least a portion of the substantially horizontal planar portion is disposed between the adjacent conductor packs, and the substantially vertical planar portion comprises at least one of a heat pipe and cooling fins.

* * * * *